US012089644B2

(12) United States Patent
Lei

(10) Patent No.: US 12,089,644 B2
(45) Date of Patent: Sep. 17, 2024

(54) ELECTRONIC ATOMIZATION DEVICE, AND ATOMIZER AND HEATING ASSEMBLY THEREOF

(71) Applicant: Shenzhen Smoore Technology Limited, Shenzhen (CN)

(72) Inventor: Guilin Lei, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 337 days.

(21) Appl. No.: 17/555,480

(22) Filed: Dec. 19, 2021

(65) Prior Publication Data

US 2022/0110370 A1 Apr. 14, 2022

Related U.S. Application Data

(63) Continuation of application No. PCT/CN2019/091277, filed on Jun. 14, 2019.

(51) Int. Cl.
*A24F 40/46* (2020.01)
*A24F 40/10* (2020.01)
(Continued)

(52) U.S. Cl.
CPC ..... *A24F 40/46* (2020.01); *A24F 40/10* (2020.01); *A24F 40/48* (2020.01); *A24F 40/57* (2020.01)

(58) Field of Classification Search
CPC ..... A24F 40/46; A24F 40/48; A24F 40/10; A24F 40/57
(Continued)

(56) References Cited

U.S. PATENT DOCUMENTS 10,081,531 B2 * 9/2018 Murison ..... B67D 7/42
10,130,119 B2 * 11/2018 Murison ..... B67D 7/02
(Continued)

FOREIGN PATENT DOCUMENTS

CN 104323433 A 2/2015
CN 205492631 U 8/2016
(Continued)

OTHER PUBLICATIONS

European search report, European Application No. 19932401.3, mailed Jun. 20, 2022 (7 pages).
(Continued)

*Primary Examiner* — Gary F Paumen

(57) ABSTRACT

An electronic atomization device, and an atomizer and a heating assembly thereof. The heating assembly includes a porous body and heating element. The porous body includes a porous body configured to suck liquid medium and a heating element configured to heat and atomize the liquid medium sucked in the porous body; the porous body includes a first surface and a second surface opposite to the first surface, and the first surface is an atomization surface configured to mount the heating element. The second surface is recessed inwards to form a liquid guiding hole configured to receive a liquid guiding element, the liquid guiding hole has a bottom surface, a projection region of the bottom surface projected on the atomization surface is defined as a core atomization region, and the core atomization region is a region in which the heating element is intensively distributed.

20 Claims, 11 Drawing Sheets

(51) Int. Cl.
*A24F 40/48* (2020.01)
*A24F 40/57* (2020.01)

(58) Field of Classification Search
USPC ..... 131/329
See application file for complete search history.

(56) References Cited

U.S. PATENT DOCUMENTS

| | | | | |
|---|---|---|---|---|
| 2009/0126745 | A1* | 5/2009 | Hon | H01M 10/425 131/273 |
| 2015/0059780 | A1* | 3/2015 | Davis | A24F 40/46 392/386 |
| 2017/0079332 | A1* | 3/2017 | Li | A24F 40/46 |
| 2017/0105453 | A1* | 4/2017 | Li | C04B 38/00 |
| 2017/0105454 | A1* | 4/2017 | Li | A24F 40/44 |
| 2017/0196273 | A1* | 7/2017 | Qiu | A24F 40/44 |
| 2017/0325510 | A1* | 11/2017 | Hu | A24F 40/50 |
| 2019/0174832 | A1* | 6/2019 | Lin | A61M 15/06 |
| 2020/0060344 | A1* | 2/2020 | Tan | A24F 40/70 |
| 2020/0315251 | A1* | 10/2020 | Ding | A24F 40/46 |
| 2021/0112869 | A1* | 4/2021 | Liu | C03C 8/14 |

FOREIGN PATENT DOCUMENTS

| | | | |
|---|---|---|---|
| CN | 205567818 | U | 9/2016 |
| CN | 107076406 | A | 8/2017 |
| CN | 107801375 | A | 3/2018 |
| CN | 107951079 | A | 4/2018 |
| CN | 108125276 | A | 6/2018 |
| CN | 108185536 | A | 6/2018 |
| CN | 108308715 | A | 7/2018 |
| CN | 207978958 | U | 10/2018 |
| CN | 109259333 | A | 1/2019 |
| CN | 208318240 | U | 1/2019 |
| CN | 208403269 | U | 1/2019 |
| CN | 109288136 | A | 2/2019 |
| CN | 109608206 | A | 4/2019 |
| CN | 109805460 | A | 5/2019 |
| CN | 109846097 | A | 6/2019 |
| CN | 210581001 | U | 5/2020 |
| WO | WO2017139963 | A1 | 8/2017 |

OTHER PUBLICATIONS

International search report, International Application No. PCT/CN2019/091277, mailed Feb. 26, 2020 (6 pages).

The Written Opinion of the International Search Authority, International Application No. PCT/CN2019/091277, mailed Feb. 26, 2020 (7 pages).

European First examination report , European Application No. 19932401.3, mailed Mar. 18, 2024 (5 pages).

Chinese First Office Action, Chinese Application No. 201910515569.4, mailed Feb. 8, 2024 (17 pages).

Chinese Second Office Action, Chinese Application No. 201910515569.4, mailed Jul. 26, 2024 (27 pages).

* cited by examiner

ELECTRONIC ATOMIZATION DEVICE, AND ATOMIZER AND HEATING ASSEMBLY THEREOF

CROSS REFERENCE TO RELATED APPLICATIONS

The present application is a continuation-application of International (PCT) Patent Application No. PCT/CN2019/091277 filed Jun. 14, 2019, the entire contents of which are hereby incorporated by reference in its entirety.

TECHNICAL FIELD

The described embodiments relate to the field of smoker's products, and more specifically, to an electronic atomization device, an atomizer and a heating assembly thereof.

BACKGROUND

Electronic cigarettes are also known as virtual cigarettes or electronic atomization devices. As alternatives to cigarettes, electronic cigarettes are mostly used to assist in smoking cessation. The electronic cigarettes have appearances and tastes similar to the cigarettes, but generally do not contain harmful ingredients, such as tar, suspended particles, and the like, in cigarettes.

An electronic cigarette mainly includes an atomizer and a power supply device. The atomizer generally includes a heating assembly that heats and atomizes cigarette liquid after being energized. The heating assembly generally includes a porous structure for liquid guiding and a heating element cooperated with the porous structure. An oil supply area of the existing heating assembly is usually greater than an atomization area. Under the condition of unobstructed ventilation, liquid leakage is likely to occur, that is, the cigarette liquid may be leaked, which results in a waste of the cigarette liquid and poor user experience. The leaked cigarette liquid even pollutes electronic components, thereby leading to a failure of the electronic components.

SUMMARY

The technical solution adopted by some embodiments of the present disclosure to solve the technical problem is to construct a heating assembly for an atomizer, including a porous body configured to suck liquid medium and a heating element configured to heat and atomize the liquid medium sucked in the porous body; the porous body comprises a first surface and a second surface opposite to the first surface, and the first surface is an atomization surface configured to mount the heating element.

The second surface is recessed inwards to form a liquid guiding hole configured to receive a liquid guiding element, the liquid guiding hole has a bottom surface, a projection region of the bottom surface projected on the atomization surface is defined as a core atomization region, and the core atomization region is a region in which the heating element is intensively distributed.

During a normal operation, after the heating element is heated for a preset time period, a first average temperature of the core atomization region is higher than a second average temperature of the atomization surface.

In some embodiments, a temperature difference between the first average temperature and the second average temperature is configured to enable a part of the liquid medium in a periphery of the core atomization region to flow towards the core atomization region.

In some embodiments, the first average temperature is in range of 120-200° C., and the first average temperature is greater than the second average temperature by more than 20° C.

In some embodiments, a width of the heating element keeps substantially constant in an extending direction of the heating element, and the core atomization region is located in a center position of the atomization surface.

In some embodiments, the atomization surface has a first width L1, the core atomization region has a second width L2 along an extending direction of the first width L1, and a ratio of the second width L2 to the first width L1 is 30%-85%.

In some embodiments, the ratio of the second width L2 to the first width L1 is 63%-70%.

In some embodiments, 40-90% of the heating element is located in the core atomization region.

In some embodiments, the porous body includes a first base and a second base cooperatively define a stepped structure, a cross-sectional area of the first base is greater than a cross-sectional area of the second base, and a side surface of the first base that is away from the second base is far away from the second base defines the atomization surface.

In some embodiments, the heating assembly further includes a first electrode and a second electrode connected to two opposite ends of the heating element, respectively, wherein the first electrode and the second electrode are arranged diagonally on the atomization surface.

In some embodiments, a shape of the heating element is configured such that an area required to be heated by the heating element per unit length in the core atomization region is substantially the same.

In some embodiments, the heating element is s symmetrically arranged with respect to a center point of the atomization surface. The heating element is symmetrically arranged with respect to a center point of the atomization surface, and the heating element comprises a first horizontal straight section, a second horizontal straight section, and a connecting section connected to the first horizontal straight section and the second horizontal straight section; the second horizontal straight section is substantially parallel to the first horizontal straight section.

The connecting section comprises a first arc section connected to the first horizontal straight section, a second arc section connected to the second horizontal straight section, and a first oblique straight section connected to the first arc section and the second arc section. The first arc section and the second arc section are located on a same circumference, and the first arc section and the second arc section are disposed adjacent to or located at an edge of the core atomization region.

In some embodiments, the heating element is s symmetrically arranged with respect to a center point of the atomization surface. The heating element comprises a first horizontal straight section, a second horizontal straight section substantially parallel to the first horizontal straight section, and a connecting section connected to the first horizontal straight section and the second horizontal straight section.

The connecting section comprises at least one third horizontal straight section and at least one first curved section connected to the at least one third horizontal straight section. The at least one third horizontal straight section is substantially perpendicular to the first horizontal straight section.

In some embodiments, the heating element is s symmetrically arranged with respect to a center point of the atomization surface. The heating element comprises a first horizontal straight section, a second horizontal straight section substantially parallel to the first horizontal straight section, and a connecting section connected to the first horizontal straight section and the second horizontal straight section.

The connecting section comprises at least one second oblique straight section, at least one third oblique straight section, and at least one fourth horizontal straight section connected to the at least one second oblique straight section and the at least one third oblique straight section, and substantially parallel to the first horizontal straight section. The at least one second oblique straight section is intersected with the at least one third oblique straight section, and an angle between the at least one second oblique straight section and the at least one fourth horizontal straight section is substantially equal to an angle between the at least one third oblique straight section and the at least one fourth horizontal straight section.

In some aspects of the present disclosure, an atomizer may also be provided. The atomizer includes the heating assembly as described in any one of the above, liquid storage chamber configured to store liquid medium, and a liquid guiding element connected to the heating assembly and the liquid storage chamber.

In some embodiments, the liquid guiding element is made of porous material, and the liquid guiding element comprises at least one honeycomb hole arranged in a honeycomb shape.

In some aspects of the present disclosure, an electronic atomization device may also be provided. The electronic atomization device includes a power supply device and the atomizer according to any one of the above, and the power supply device is electrically connected to the atomizer.

BRIEF DESCRIPTION OF THE DRAWINGS

The present disclosure will be further described below in conjunction with the accompanying drawings and embodiments.

DETAILED DESCRIPTION

In order to have a clearer understanding of the technical features, objectives, and effects of the present disclosure, embodiments of the present disclosure will now be described in detail with reference to the accompanying drawings.

Figure 2:
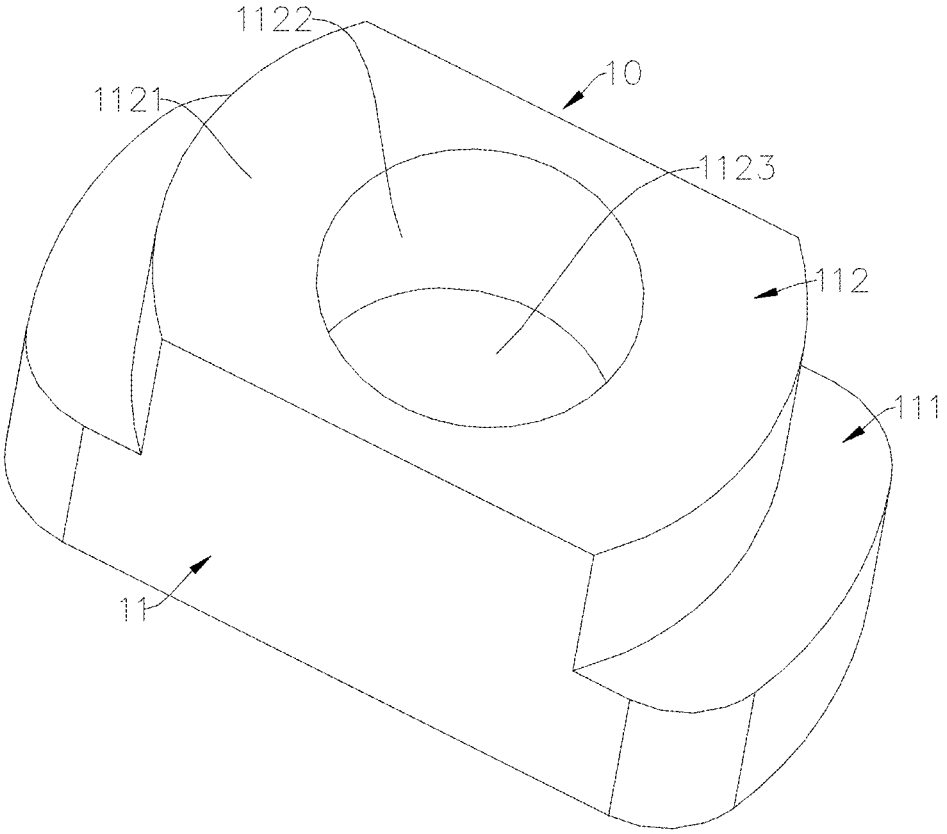
FIG. 2 is a schematic perspective view of a heating assembly in some embodiments of the present disclosure.
Figure 3:
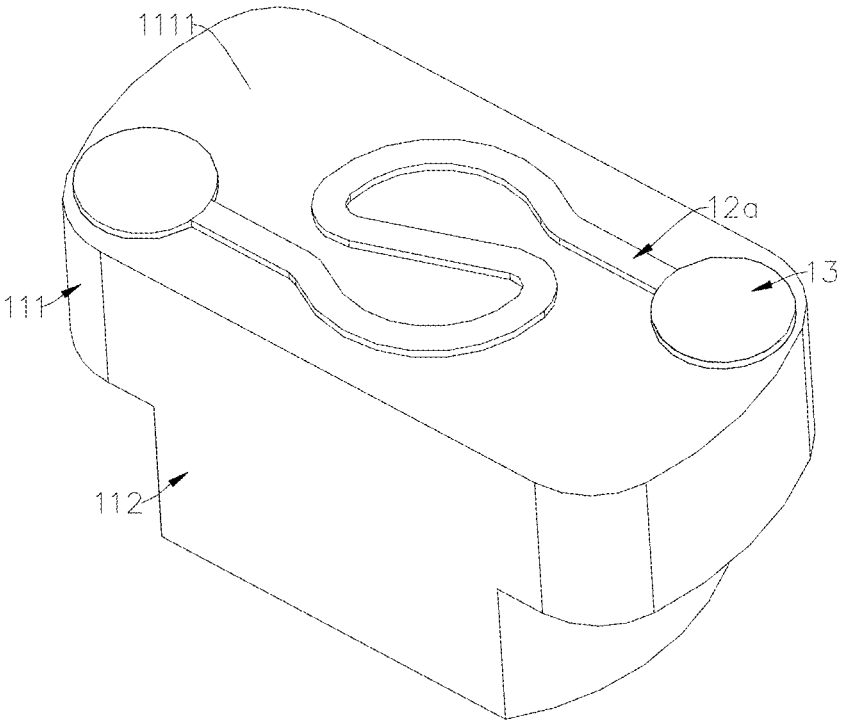
FIG. 3 is a schematic perspective view of another perspective of the heating assembly in some embodiments of the present disclosure.
Figure 4:
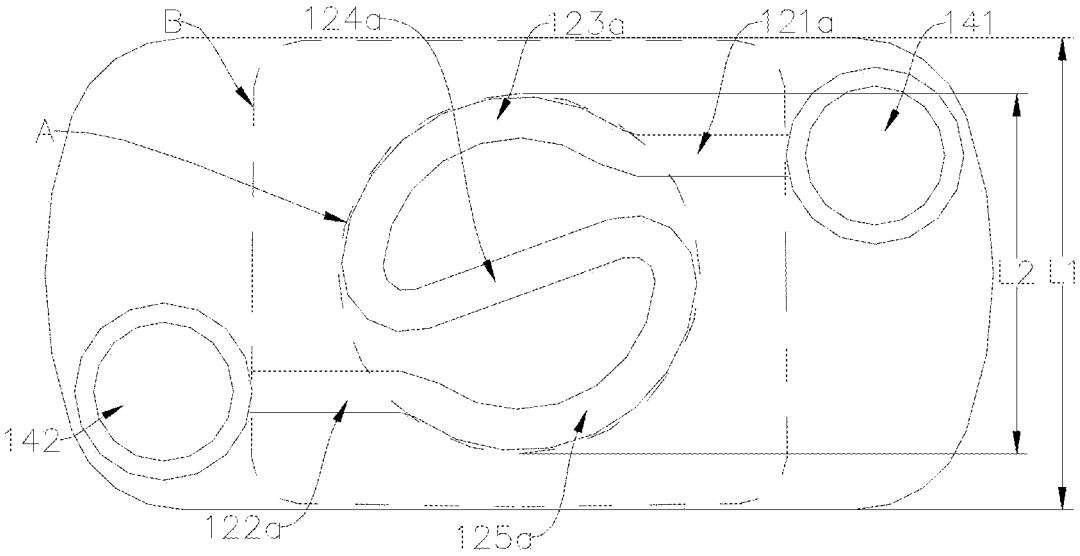
FIG. 4 is a top view of the heating assembly in some embodiments of the present disclosure.
Figure 15:
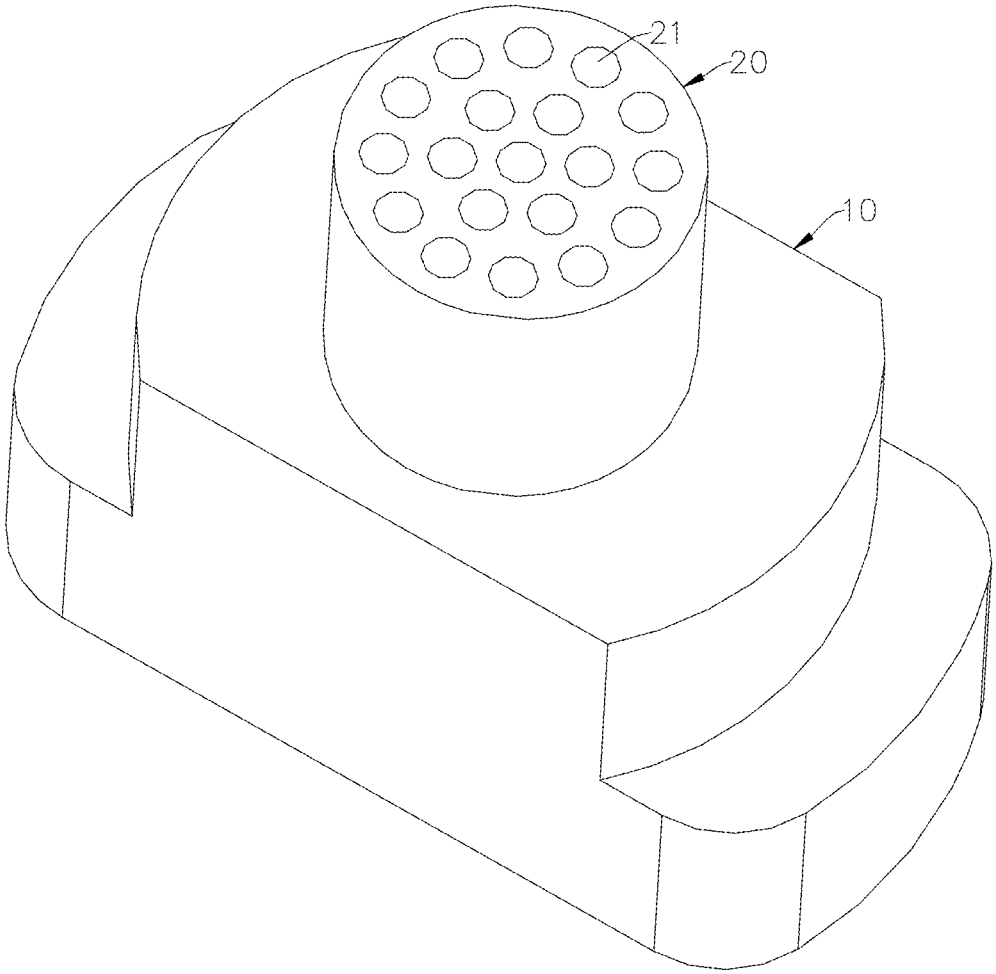
FIG. 15 is a schematic structural view of the heating assembly and the liquid guiding element in some embodiments of the present disclosure.

FIGS. 2-4 show a heating assembly 10 in some embodiments of the present disclosure. The heating assembly 10 may be configured in an atomizer to heat and atomize liquid medium such as cigarette liquid, medicinal liquid, or the like. The heating assembly 10 may include a porous body 11 and a heating element 12*a*. The porous body 11 may be configured to suck or absorb the liquid medium. The heating element 12*a* may be configured to heat and atomize the liquid medium sucked in the porous body 11. The porous body 11 may include a first surface and a second surface 1121 opposite to the first surface. In some embodiments, the first surface may be an atomization surface 1111 configured to mount the heating element 12*a*. The second surface 1121 may be recessed inwards (that is, recessed in a direction oriented from the second surface 1121 to the first surface) to form a liquid guiding hole 1122 configured to receive a liquid guiding element 20 (as shown in FIG. 15). A shape of the liquid guiding hole 1122 may not be limited to a round hole, and may be other shapes such as a square hole, a rectangular hole, or the like.

In some embodiments, the porous body 11 may have a stepped structure, that is, the porous body 11 may be in shape of a step. The porous body 11 may include a first base 111 and a second base 112. The first base 111 and the second base 112 cooperatively form or define the stepped structure. A cross-sectional area of the first base 111 may be greater than a cross-sectional area of the second base 112, such that a positioning step may be formed between the first base 111 and the second base 112. Thus, it is possible to facilitate the mounting and positioning of the heating assembly 10. In some embodiments, the atomization surface 1111 may be a side surface of the first base 111 that is remote from or away from the second base 112. In this way, the area of the atomization surface 1111 may be increased in the case of occupying the same space.

In some embodiments, each of the first base 111 and the second base 112 may be substantially in shape of a cuboid, and the atomization surface 1111 may be formed on a rectangular surface of the first base 111. Furthermore, a length of the first base 111 may be greater than a length of the second base 112, and a width of the first base 111 may be substantially equal to a width of the second base 112. In other embodiments, the cross-sections of the first base 111 and the second base 112 may also have other shapes such as circles, ellipses, rhombuses, squares, or the like.

The liquid guiding hole 1122 may have a bottom surface 1123. A projection region of the bottom surface 1123 of the liquid guiding hole 1122 projected on the atomization surface 1111 may be defined as a core atomization region A. In some embodiments, the core atomization region A may be an intensive distribution region of the heating element 12*a*, that is to say, a region in which most part of the heating element 12*a* is intensively distributed or located. During a normal operation, after the heating member 12*a* is heated for a preset time period, a first average temperature of the core atomization region A may be higher or greater than a second average temperature of the entire atomization surface 1111.

The atomization surface 1111 may generally include a core atomization region A and a peripheral atomization region B located out of the core atomization region A. The core atomization region A may be generally located in a center position of the atomization surface 1111. The liquid guiding element may be configured to guide the liquid medium in a liquid storing chamber of the atomizer to the porous body 11. The liquid medium may be diffused or spread outwards around a center defined by the bottom surface 1123 of the liquid guiding hole 1122. A region of the atomization surface 1111 corresponding to the bottom surface 1123 may be defined as the core atomization region A, while the peripheral atomization region B may be formed by spreading the liquid. In the heating process of the heating assembly 10, since a temperature of the core atomization region A is higher or greater, the liquid medium may be volatilized faster. In addition to the liquid medium in the liquid guiding element, a part of the liquid medium in the peripheral atomization region B may also flow to the core atomization region A and be gathered towards the core atomization region A. In this way, the peripheral atomization region B may be limited to a certain range, and thus it is possible to reduce the occurrence of the liquid leakage, and a user will not suck in droplets when sucking in the smoke, which improves the user experience.

In some embodiments, a temperature difference between the first average temperature and the second average temperature may be configured to enable a part of the liquid medium in the peripheral atomization region B to flow towards the core atomization region A. In some embodiments, the first average temperature may be in range of 120-200° C., and the first average temperature may be higher or greater than the second average temperature by more than 20° C.

Generally, a width of the heating element 12*a* may keep substantially constant or uniform in an extending direction of the heating element 12*a*. A distribution density of the heating element 12*a* in the core atomization region A may be greater than a distribution density of the heating element 12*a* in the peripheral atomization region B located out of the core atomization region A. In some embodiments, the distribution density may be a ratio of an area occupied by the heating element 12*a* in the core atomization region A (or the peripheral atomization region B) to an area of the core atomization region A (or the peripheral atomization region B).

In general, 40-90% of the heating element 12*a* may be distributed in the core atomization region A. The atomization surface 1111 may have a first width L1, the core atomization region A may have a second width L2 along an extending direction of the first width L. A ratio of the second width L2 to the first width L1 may be 30%-85%. In some embodiments, the ratio of the second width L2 to the first width L1 may be about ⅔. Further, the ratio of the second width L2 to the first width L1 may be generally selected from a range of 63%-70%.

A first electrode 141 and a second electrode 142 may be provided at two opposite ends of the heating element 12*a*, respectively. The first electrode 141 and the second electrode 142 may be configured to electrically connect to a positive electrode and a negative electrode of a power supply device, respectively. Generally, the peripheral atomization region B may be located in space defined between the first electrode 141 and the second electrode 142.

The heating assembly 10 may adopt various air intake methods such as side air intake, bottom air intake, or the like. When the heating assembly 10 adopts the side air intake, the first electrode 141 and the second electrode 142 may be arranged diagonally on the atomization surface 1111. In this way, it is possible to optimize a delivery effect of the smoke when using the side air intake, and effectively reduce the occurrence of obstruction of the first electrode 141 and the second electrode 142 to the airflow, which reduces retention of the smoke in an atomization cavity, and thus a flow efficiency of the smoke may be improved.

The heating element 12*a* may be a heating film or a heating wire. The heating element 12*a* may be made of material such as metal. Two opposite ends of the heating element 12*a* may be arranged with pads 13 configured to mount the first electrode 141 and the second electrode 142. In some embodiments, the heating element 12*a* is a heating film, and may be printed on the atomization surface 1111 of the porous body 11 by using electronic paste. When the porous body 11 is a sintered element, the heating element 12*a* may be integrally formed with the porous body 11 by sintering.

In some embodiments, the heating film may include a first cover film and a second cover film sequentially arranged or formed on the atomization surface 1111. Both the first cover film and the second cover film may be porous films. Material of the first cover film may be titanium, zirconium, titanium-aluminum alloy, titanium-zirconium alloy, titanium-molybdenum alloy, titanium-niobium alloy, iron-aluminum alloy, tantalum-aluminum alloy, or the like. Material of the second cover film may be platinum, palladium, palladium-copper alloy, gold-silver-platinum alloy, gold-silver alloy, palladium-silver alloy, gold-platinum alloy, or the like. In some embodiments, the first cover film may be a titanium-zirconium alloy film, and the second cover film may be a gold-silver alloy film.

The porous body 11 may be made of a hard capillary structure such as porous ceramic, porous glass ceramic, porous glass, or the like. In some embodiments, the porous body 11 may be made of the porous ceramic. The porous ceramic is able to be resistant to a high temperature, has stable chemical properties, and will not chemically react with cigarette liquid. Besides, the porous ceramic is an insulator, and thus, problems such as a short circuit may not be occurred since the porous ceramic will not be electrically connected to the heating element 12*a* arranged on the porous body 11. Therefore, the porous body 11 made of porous ceramic is convenient to manufacture and has low cost.

In some embodiments, a pore diameter of a micropore in the porous ceramic may range from 1 μm to 100 μm. An average pore diameter of the porous ceramic may be in range of 10-35 μm. In some embodiments, the average pore diameter of the porous ceramic is 20-25 μm.

In some embodiments, a ratio of a total volume of the micropores with a pore diameter of 5-30 μm in the porous ceramic to a total volume of all the micropores in the porous ceramic may be greater than 60%. In some embodiments, a ratio of a total volume of the micropores with a pore diameter of 10-15 μm in the porous ceramic to the total volume of all the micropores in the porous ceramic may be greater than 20%. In some embodiments, a ratio of a total volume of the micropores with a pore diameter of 30-50 μm in the porous ceramic to the total volume of all the micropores in the porous ceramic may be greater than 30%.

In some embodiments, a porosity of the porous ceramic may be in range of 30% to 70%. Herein, the porosity may refer to a ratio of a total volume of the micro-voids or micropores in a porous medium to a total volume of the porous medium. The porosity may be adjusted according to a composition of the cigarette liquid. For example, if the cigarette liquid has a greater viscosity, the porosity may be greater to ensure a liquid guiding effect. In some embodiments, the porosity of the porous ceramic may be in range of 50-60%.

The heating element 12*a* may be symmetrically arranged with respect to a center point of the atomization surface 1111. In some embodiments, the atomization surface 1111 may be substantially rectangular, and the core atomization region A may be substantially circular.

The heating element 12*a* may include a first horizontal straight section 121*a*, a second horizontal straight section 122*a*, and a connecting section connected to the first horizontal straight section 121*a* and the second horizontal straight section 122*a*. The first horizontal straight section 121*a* may be substantially parallel to the second horizontal straight section 122*a*, and may be arranged along a longitudinal direction or a length direction of the atomization surface 1111.

The connecting section may include a first arc section 123*a* connected to the first horizontal straight section 121*a*, a second arc section 125*a* connected to the second horizontal straight section 122*a*, and a first oblique straight section 124*a* connected to the first arc section 123*a* and the second arc section 125*a*. The first arc section 123*a* and the second arc section 125*a* may be located on a same circumference of a circle, and the first arc section 123*a* and the second arc section 125*a* may be disposed close to or adjacent to or located at an edge of the core atomization region A. Two opposite ends of the first oblique straight section 124*a* may be connected to the first arc section 123*a* and the second arc section 125*a* by a straight line or an arc, respectively.

Figure 6:
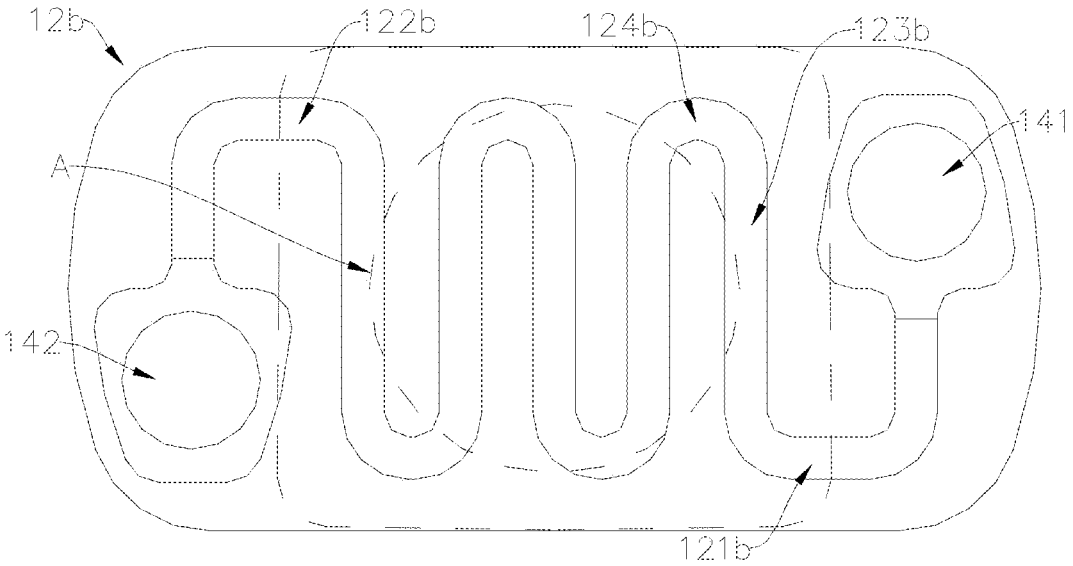
FIG. 6 is a schematic structural view of a first alternative to the heating assembly of the heating assembly shown in FIG. 4.

FIG. 6 shows a heating element 12*b* in some embodiments of the present disclosure, which may be used as an alternative to the heating element 12*a* of the heating assembly 10 described above. The heating element 12*b* may include a first horizontal straight section 121*b*, a second horizontal straight section 122*b*, and a connecting section connected to the first horizontal straight section 121*b* and the second horizontal straight section 122*b*. The first horizontal straight section 121*b* may be substantially parallel to the second horizontal straight section 122*b*. The first horizontal straight section 121*b* may be arranged along the longitudinal direction or the length direction of the atomization surface 1111.

The connecting section may include at least one third horizontal straight section 123*b* and at least one first curved section 124*b* connected to the at least one third horizontal straight section 123*b*. The third horizontal straight section 123*b* may be substantially perpendicular to the first horizontal straight section 121*b*. Most of the connecting section may be arranged in the core atomization region A. A length of the connecting section along a length direction of the atomization surface 1111 or a width of the connection section along a width direction of the atomization surface 1111 may be the same or substantially the same as a diameter of the core atomization region A.

Figure 8:
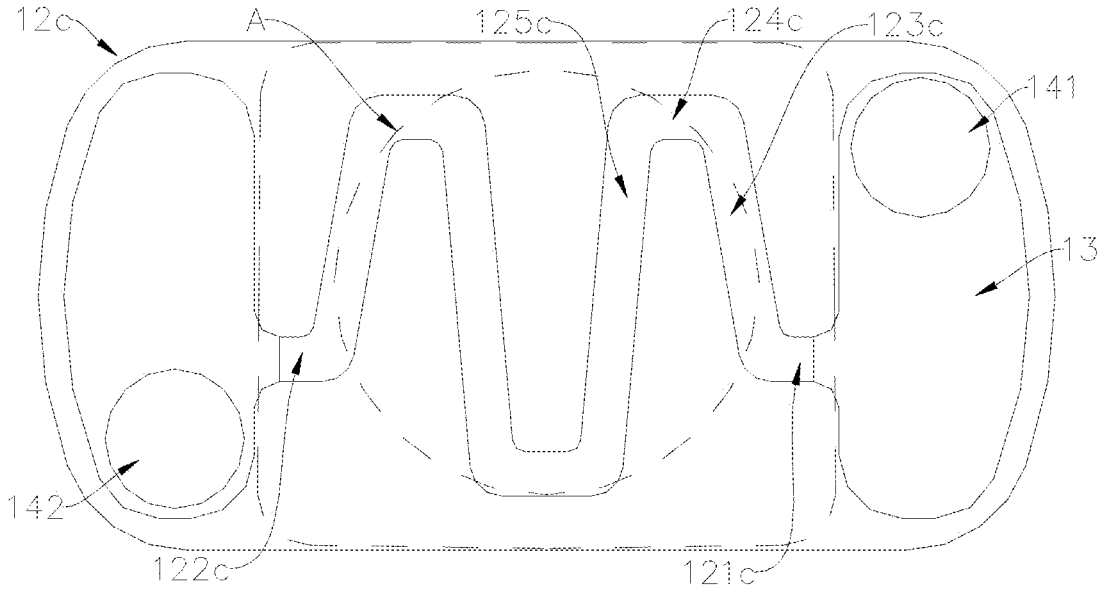
FIG. 8 is a schematic structural view of a second alternative to the heating assembly of the heating assembly shown in FIG. 4.

FIG. 8 shows a heating element 12*c* in some embodiments of the present disclosure, which may be used as an alternative to the heating element 12*a* of the heating assembly 10 described above. The heating element 12*c* may include a first horizontal straight section 121*c*, a second horizontal straight section 122*c*, and a connecting section connected to the first horizontal straight section 121*c* and the second horizontal straight section 122*c*. The first horizontal straight section 121*c* may be substantially parallel to the second horizontal straight section 122*c*, and the first horizontal straight section 121*c* may be arranged along the longitudinal direction or the length direction of the atomization surface 1111.

The connecting section may include at least one second oblique straight section 123*c*, at least one third oblique straight section 125*c*, and at least one fourth horizontal straight section 124*c* connected to the at least one second oblique straight section 123*c* and at least one third oblique straight section 125*c*. The at least one fourth horizontal straight section 124*c* may be substantially parallel to the first horizontal straight section 121*c*. The second oblique straight section 123*c* may be intersected with the third oblique straight section 125*c*. An angle between the second oblique straight section 123*c* and the fourth horizontal straight section 124*c* may be substantially equal to an angle between the third oblique straight section 125*c* and the fourth horizontal straight section 124*c*. The second oblique straight section 123*c* and the third oblique straight section 125*c* located at an outermost periphery of the connecting section may be connected to the two pads 13, respectively. Most of the connecting section may be arranged in the core atomization region A. A length of the connecting section along the length direction of the atomization surface 1111 or a width of the connection section along the width direction of the atomization surface 1111 may be the same or substantially the same as a diameter of the core atomization region A.

In this embodiment, the connecting section includes two second oblique straight sections 123*c*, two third oblique straight sections 125*c*, and three fourth horizontal straight sections 124*c* connected to the two second oblique straight section 123*c* and the two oblique straight section 125*c*.

Figure 10:
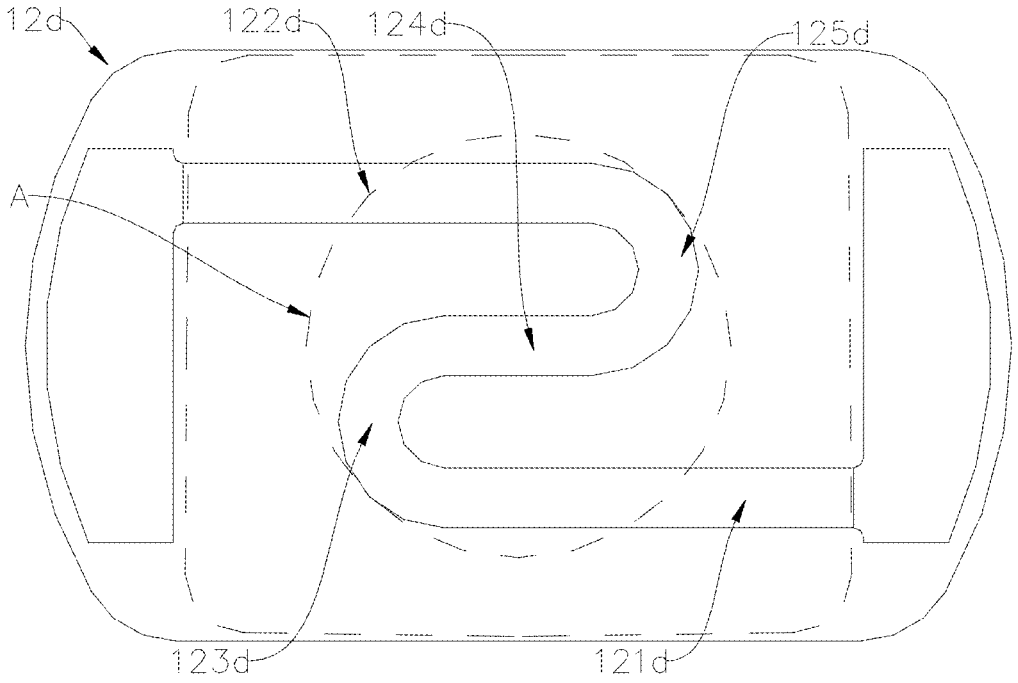
FIG. 10 is a schematic structural view of a third alternative to the heating assembly of the heating assembly shown in FIG. 4.

FIG. 10 shows a heating element 12*d* in some embodiments of the present disclosure, which may be used as an alternative to the heating element 12*a* of the heating assembly 10 described above. The heating element 12*d* may include a first horizontal straight section 121*d*, a second horizontal straight section 122*d*, and a connecting section connected to the first horizontal straight section 121*d* and the second horizontal straight section 122*d*. The first horizontal straight section 121*d* may be substantially parallel to the second horizontal straight section 122*d*, and may be arranged along the longitudinal direction or the length direction of the atomization surface 1111.

The connecting section may include a second curved section 123*d* connected to the first horizontal straight section 121*d*, a third curved section 125*d* connected to the second horizontal straight section 122*d*, and a fifth horizontal straight section 124*d* connected to the second curved section 123*d* and the third curved section 125*d*. The fifth horizontal straight section 124*d* may be substantially parallel to the first horizontal straight section 121*d*. The first horizontal straight section 121*d*, the second curved section 123*d*, the fifth horizontal straight section 124*d*, the third curved section 125*d*, and the second horizontal straight section 122*d* may be successively connected in series to form a substantially S-shaped structure.

Figure 5:
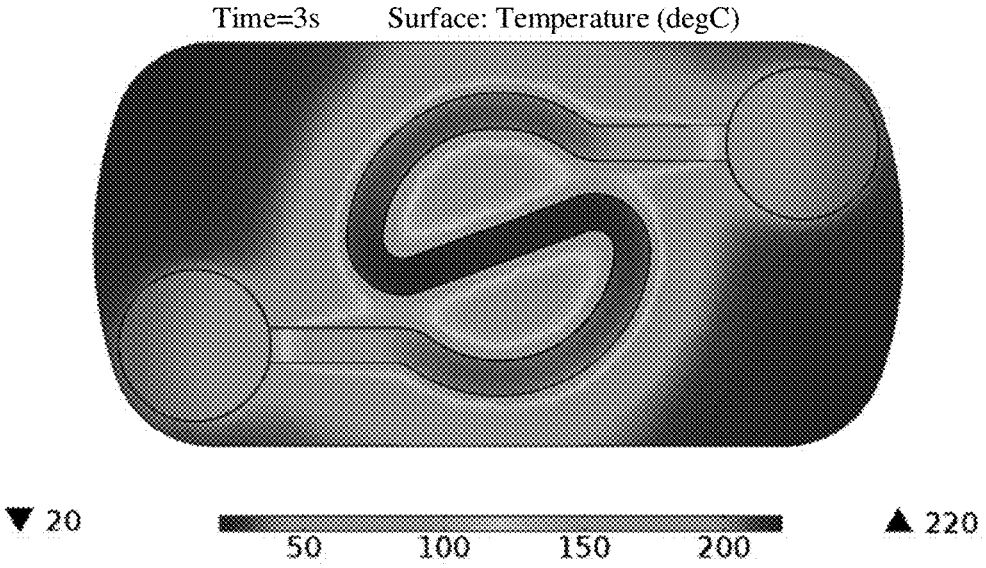
FIG. 5 is a diagram illustrating a temperature-field distribution of the heating assembly shown in FIG. 4.
Figure 7:
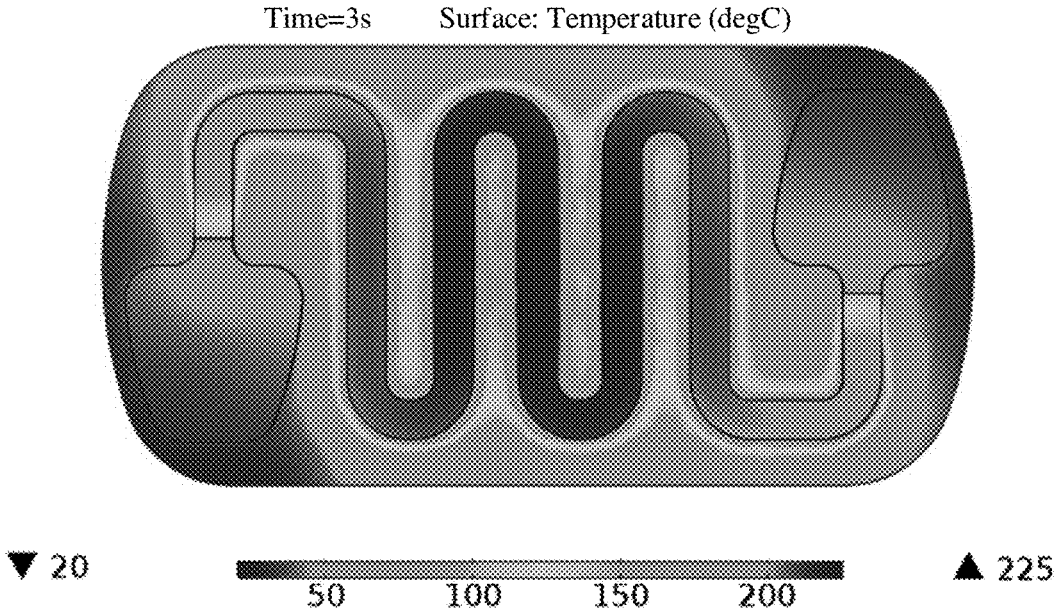
FIG. 7 is a diagram illustrating a temperature-field distribution of the heating assembly shown in FIG. 6.
Figure 9:
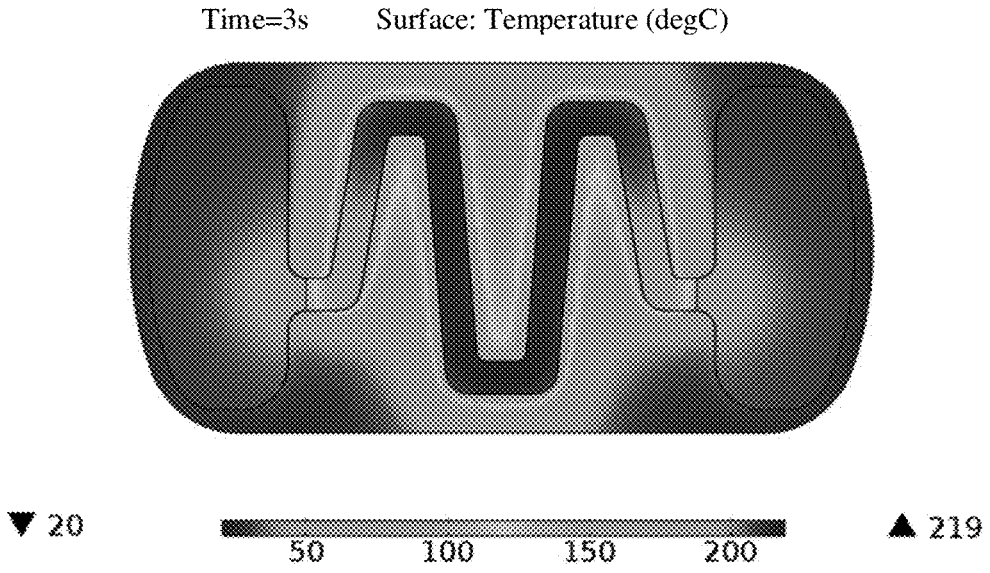
FIG. 9 is a diagram illustrating a temperature-field distribution of the heating assembly shown in FIG. 8.

FIGS. 5, 7, and 9 show temperature-field distribution diagrams of the atomization surface 1111 after the heating elements shown in FIGS. 4, 6, and 8 have been heated for 3 seconds. According to simulation experiments, the first average temperature of the core atomization region A may be in range of 120-200° C., and an average temperature of the peripheral atomization region B may be below about 120° C. When the user smokes, since the temperature of the core atomization region A is high enough, the cigarette liquid may be volatilized fast. In this way, the cigarette liquid in the peripheral atomization region B may flow and be gathered towards the core atomization region A. Thus, it is possible to reduce the occurrence of the liquid leakage, and the user will not suck in droplets when sucking in the smoke, which improves the user experience.

Furthermore, by changing the shape and the length of the heating element, the temperature of the heating element in a dry-firing state may be effectively reduced, thereby reducing a thermal stress between the heating element and the porous body, and further reducing a deformation amount of the heating element and the porous body. Generally, the shape of the heating element may be configured such that an area required to be heated by the heating element per unit length in the core atomization region A may be substantially the same. In this way, it is possible to reduce the possibility of an excessively high local temperature in the porous body, reduce the thermal stress between the heating element and the porous body, and further reduce the deformation amount of the heating element and the porous body.

Figure 1:
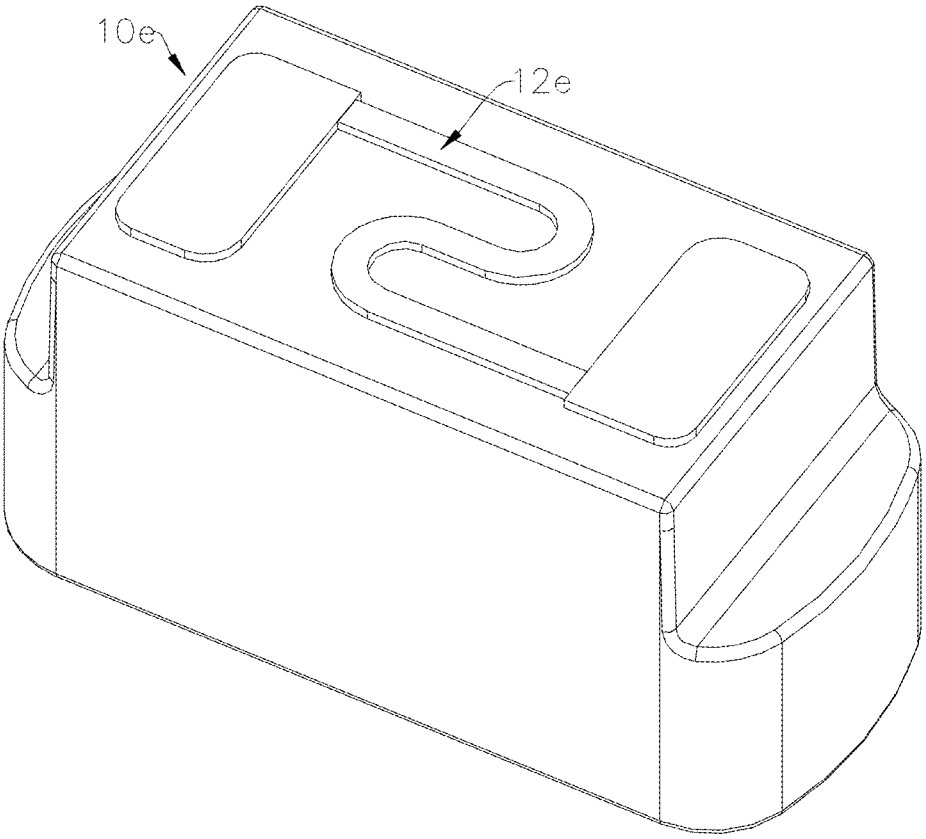
FIG. 1 is a schematic perspective view of a heating assembly in some embodiments of the related art.
Figure 11:
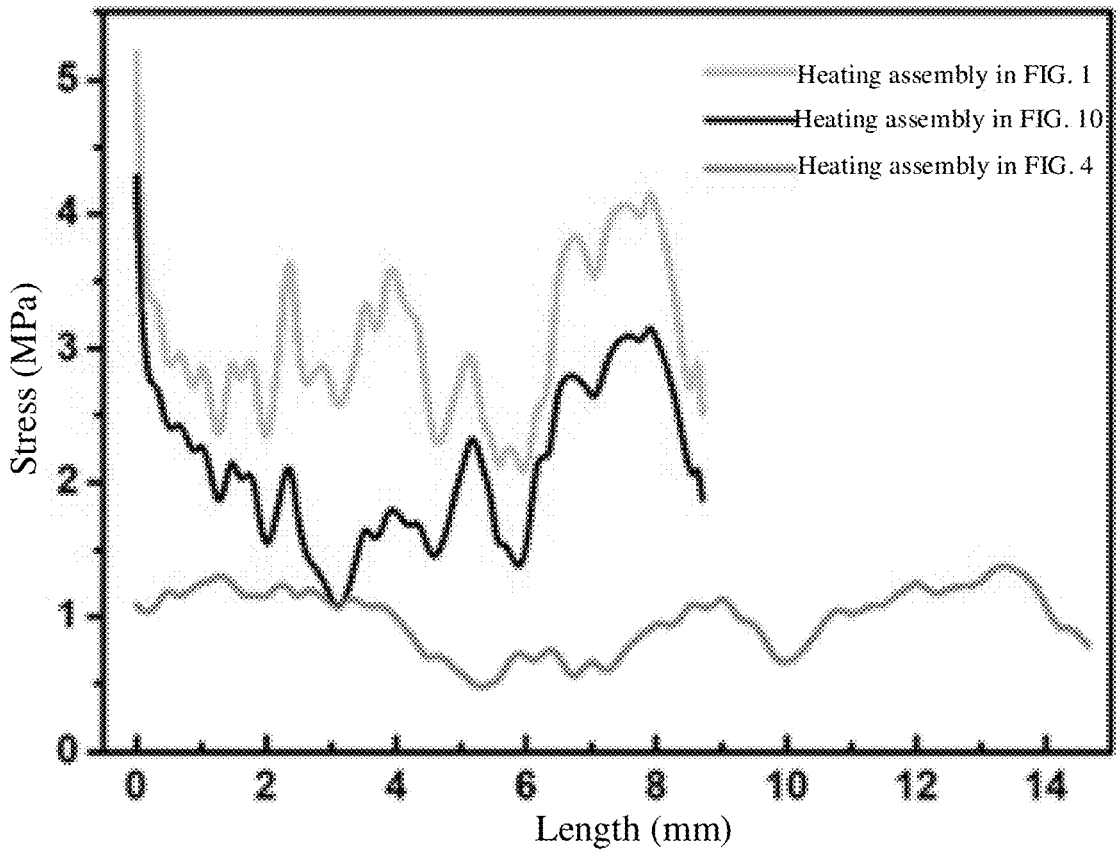
FIG. 11 is a stress comparison diagram of the heating assemblies shown in FIG. 1, FIG. 4, and FIG. 10.
Figure 12:
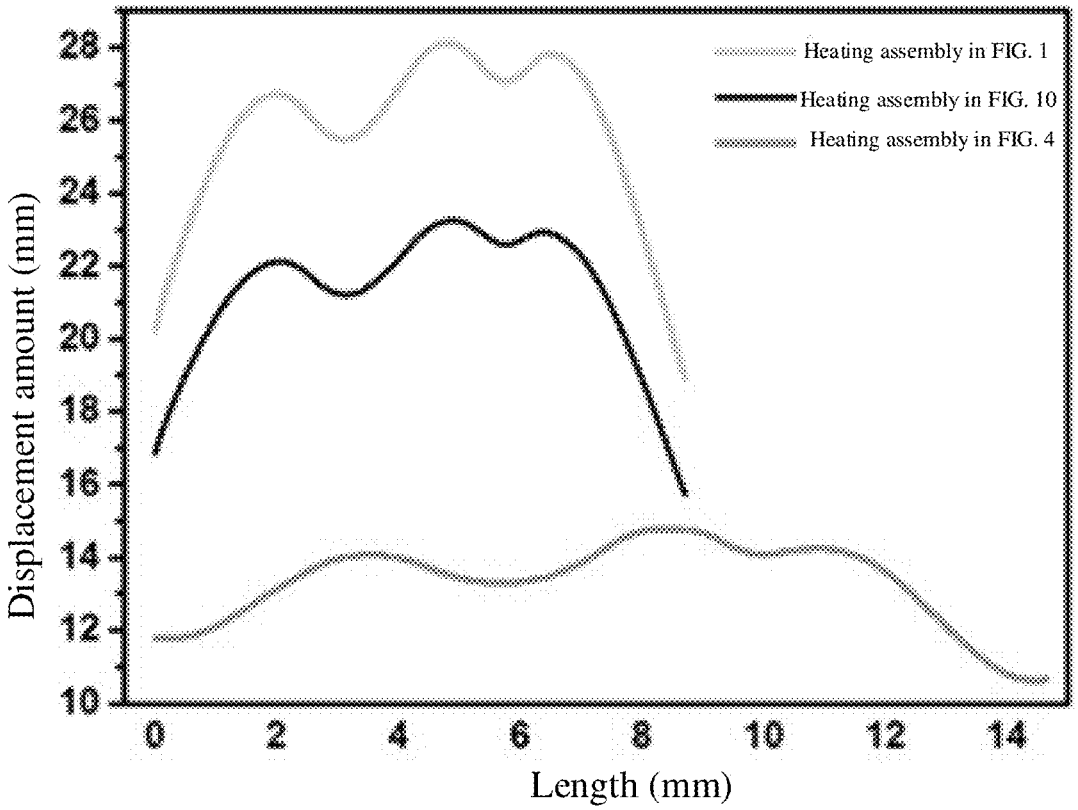
FIG. 12 is a displacement amount comparison diagram of the heating assemblies shown in FIG. 1, FIG. 4, and FIG. 10.

FIGS. 11 and 12 show a stress comparison diagram and a displacement amount (deformation amount) comparison diagram of the heating assemblies shown in FIG. 1, FIG. 4, and FIG. 10. FIG. 1 shows a heating assembly 10*e* in some embodiments of the related art. A shape of a heating element 12*e* of the heating assembly 10*e* in FIG. 1 may be similar to a shape of the heating element 12*d* shown in FIG. 10. In this simulation experiment, the heating assembly shown in FIG. 1 has an overall length of 9.05 mm and a width of 4.05 mm. The heating assembly shown in FIG. 4 has an overall length of 8 mm and a width of 4 mm. The heating assembly shown in FIG. 10 has an overall length of 10 mm and a width of 6 mm. As shown in FIGS. 11-12, the heating element shown in FIG. 1 has the greatest amount of stress and deformation, while the heating element shown in FIG. 4 has the least amount of stress and deformation. In the simulation experiment, by using the heating element of the heating assembly shown in FIG. 6 and FIG. 8 of the present disclosure, it is possible to achieve an effect regarding the stress and deformation similar to that of the heating element shown in FIG. 4 Thus, it is possible to achieve a less amount of stress and deformation of the heating element.

Figure 13:
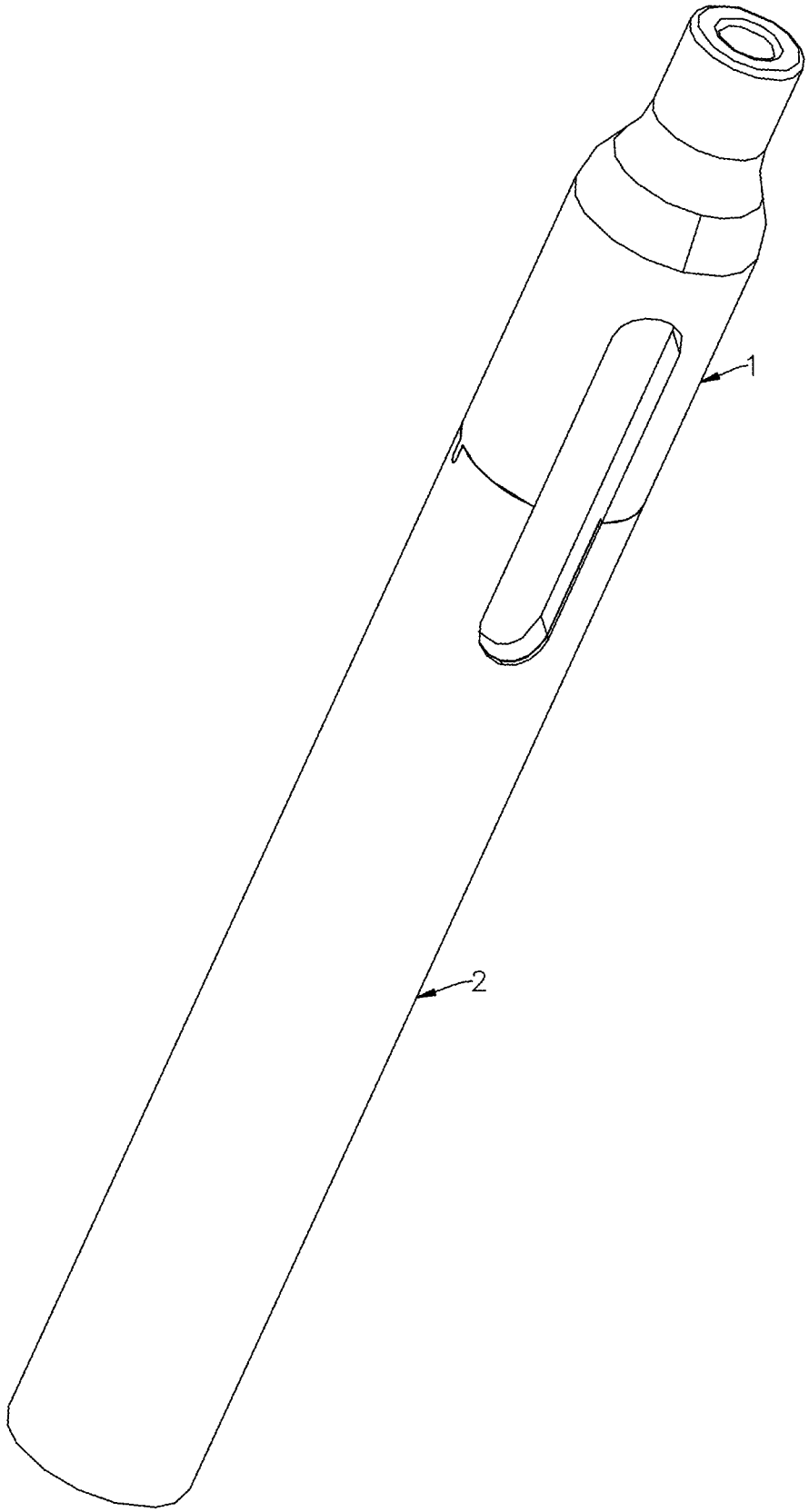
FIG. 13 is a schematic structural view of an electronic cigarette in some embodiments of the present disclosure.
Figure 14:
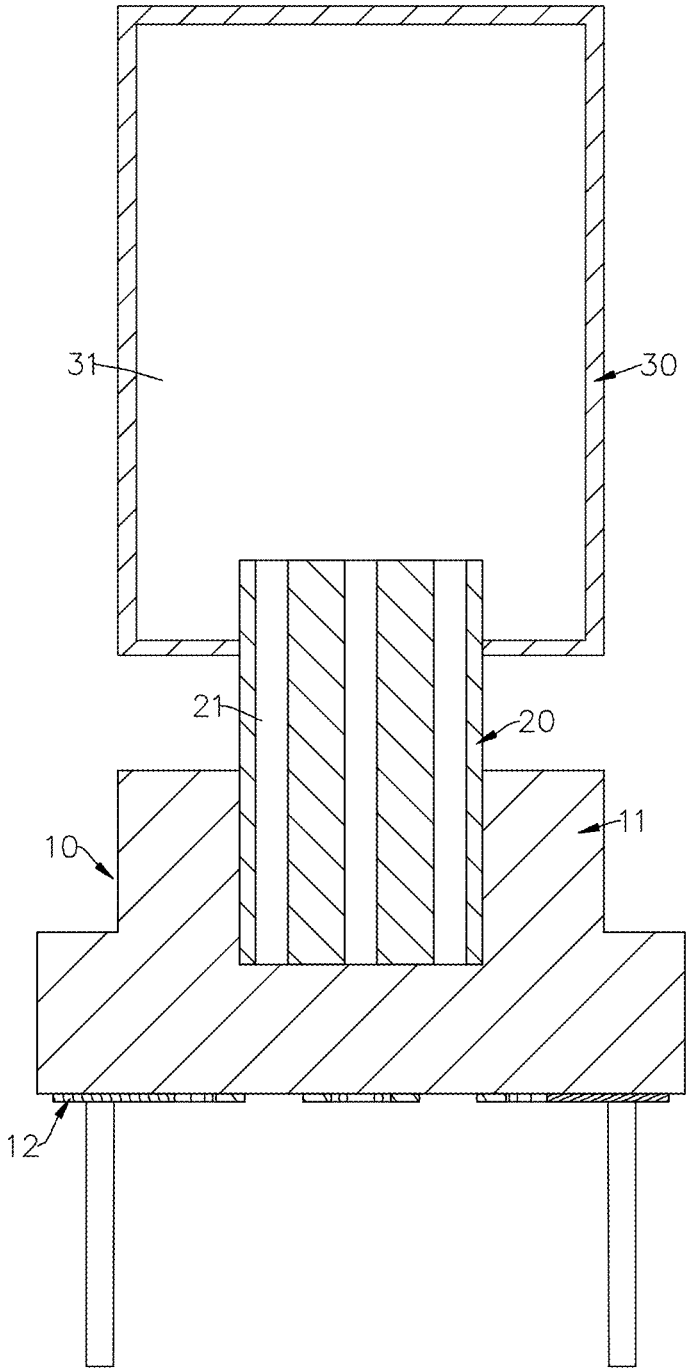
FIG. 14 is cross-sectional structural view of the heating assembly, a liquid guiding element, and a liquid storage in some embodiments the present disclosure.

FIGS. 13-15 show an electronic atomization device in some embodiments of the present disclosure. The electronic atomization device may be used as an electronic cigarette, a medical atomizer, or the like.

The electronic atomization device may include an atomizer 1 and a power supply device 2, and the power supply device 2 may be electrically connected to the atomizer 1. In some embodiments, the atomizer 1 and the power supply device 2 may be detachably connected to each other by means of such as magnetic attraction, screw connection, or the like.

The atomizer 1 may include a liquid storing chamber 31 configured to receive or store liquid medium, a heating assembly 10, and a liquid guiding element 20 connecting the liquid storing chamber 31 and the heating assembly 10. In some embodiments, the liquid guiding element 20 may be fluidly coupled to the liquid storing chamber 31 and the heating assembly 10. After the atomizer 1 is assembled with the power supply device 2, the power supply device 2 supplies power to the heating element of the heating assembly 10 in the atomizer 1, and the heating element heats and atomizes the liquid medium for the user to suck in. Understandably, any of the heating assemblies mentioned above may be applied to the electronic atomization device.

In some embodiments, the atomizer 1 may further include a liquid storage 30 configured to receive or store the liquid medium. An inner chamber of the liquid storage 30 may form the liquid storing chamber 31. A length and a shape of the liquid guiding element 20 may be adjusted as required. One end of the liquid guiding element 20 may extend into the liquid storage 30, and the other end of the liquid guiding element 20 may abut against the bottom surface of the liquid guiding hole 1122. In this way, it is possible to guide the liquid medium in the liquid storage 30 into the porous body 11, and the liquid medium is then spread outwards around the center defined by the bottom surface of the liquid guiding hole 1122.

The liquid guiding element 20 may be made of porous material. The liquid guiding element 20 may include at least one honeycomb hole 21 arranged in a honeycomb shape. By controlling a size and the number of the honeycomb holes 21, a liquid guiding amount of the liquid guiding element 20 may be better controlled. Generally, the size and the number of the honeycomb holes 21 may be adjusted according to a viscosity of the liquid medium, so that the liquid guiding amount of the liquid guiding element 20 may match with an atomizing amount of the heating element.

It can be understood that the above technical features may be used in any combination without limitation.

The above examples are only some embodiments of the present disclosure. The description to the examples is specific and detailed, but it should not be understood as a limitation to the scope of the present disclosure. It should be pointed out that for those of ordinary skill in the art, without departing from the concept of the present disclosure, the above technical features may be freely combined, and several modifications and improvements may be made. All these belong to the scope of protection of the present disclosure. Therefore, all equivalent changes and modifications made to the scope of the claims of the present disclosure shall fall within the scope of the claims of the present disclosure.

What is claimed is:

1. A heating assembly for an atomizer, comprising:

a porous body, configured to suck liquid medium and comprising a first surface and a second surface opposite to the first surface; and a heating element, configured to heat and atomize the liquid medium sucked in the porous body;

wherein the first surface is an atomization surface configured to mount to the heating element;

wherein the second surface is recessed inwards to form a liquid guiding hole configured to receive a liquid guiding element, the liquid guiding hole has a bottom surface, a projection region of the bottom surface projected on the atomization surface is defined as a core atomization region, and the core atomization region is a region in which the heating element is intensively distributed;

wherein during a normal operation, after the heating element is heated for a preset time period, a first average temperature of the core atomization region is higher than a second average temperature of the atomization surface.

2. The heating assembly as claimed in claim 1, wherein a temperature difference between the first average temperature and the second average temperature is configured to enable a part of the liquid medium in a periphery of the core atomization region to flow towards the core atomization region.

3. The heating assembly as claimed in claim 1, wherein the first average temperature is in range of 120-200° C., and the first average temperature is greater than the second average temperature by more than 20° C.

4. The heating assembly as claimed in claim 1, wherein a width of the heating element keeps substantially constant in an extending direction of the heating element, and the core atomization region is located in a center position of the atomization surface.

5. The heating assembly as claimed in claim 4, wherein the atomization surface has a first width, the core atomization region has a second width along an extending direction of the first width, and a ratio of the second width to the first width is 30%-85%.

6. The heating assembly as claimed in claim 5, wherein the ratio of the second width to the first width is 63%-70%.

7. The heating assembly as claimed in claim 4, wherein 40-90% of the heating element is located in the core atomization region.

8. The heating assembly as claimed in claim 1, wherein the porous body comprises a first base and a second base cooperatively define a stepped structure, a cross-sectional area of the first base is greater than a cross-sectional area of the second base, and a side surface of the first base that is away from the second base defines the atomization surface.

9. The heating assembly as claimed in claim 1, further comprising a first electrode and a second electrode connected to two opposite ends of the heating element, respectively, wherein the first electrode and the second electrode are arranged diagonally on the atomization surface.

10. The heating assembly as claimed in claim 1, wherein a shape of the heating element is configured such that an area required to be heated by the heating element per unit length in the core atomization region is substantially the same.

11. The heating assembly as claimed in claim 1, wherein the heating element is symmetrically arranged with respect to a center point of the atomization surface, and the heating element comprises:

a first horizontal straight section;

a second horizontal straight section, substantially parallel to the first horizontal straight section; and a connecting section, connected to the first horizontal straight section and the second horizontal straight section and comprising:

a first arc section, connected to the first horizontal straight section;

a second arc section, connected to the second horizontal straight section; and a first oblique straight section, connected to the first arc section and the second arc section;

wherein the first arc section and the second arc section are located on a same circumference, and the first arc section and the second arc section are disposed adjacent to or located at an edge of the core atomization region.

12. The heating assembly as claimed in claim 1, wherein the heating element is symmetrically arranged with respect to a center point of the atomization surface, and the heating element comprises:

a first horizontal straight section;

a second horizontal straight section, substantially parallel to the first horizontal straight section; and a connecting section, connected to the first horizontal straight section and the second horizontal straight section and comprising:

at least one third horizontal straight section; and at least one first curved section, connected to the at least one third horizontal straight section; wherein the at least one third horizontal straight section is substantially perpendicular to the first horizontal straight section.

13. The heating assembly as claimed in claim 1, wherein the heating element is s symmetrically arranged with respect to a center point of the atomization surface, and the heating element comprises:

a first horizontal straight section;

a second horizontal straight section, substantially parallel to the first horizontal straight section; and a connecting section, connected to the first horizontal straight section and the second horizontal straight section and comprising:

at least one second oblique straight section;

at least one third oblique straight section; and at least one fourth horizontal straight section, connected to the at least one second oblique straight section and the at least one third oblique straight section, and substantially parallel to the first horizontal straight section;

wherein the at least one second oblique straight section is intersected with the at least one third oblique straight section, and an angle between the at least one second oblique straight section and the at least one fourth horizontal straight section is substantially equal to an angle between the at least one third oblique straight section and the at least one fourth horizontal straight section.

14. An atomizer, comprising:

a heating assembly, comprising:

a porous body, configured to suck liquid medium and comprising a first surface and a second surface opposite to the first surface; and a heating element, configured to heat and atomize the liquid medium sucked in the porous body;

wherein the first surface is an atomization surface configured to mount the heating element;

wherein the second surface is recessed inwards to form a liquid guiding hole configured to receive a liquid guiding element, the liquid guiding hole has a bottom surface, a projection region of the bottom surface projected on the atomization surface is defined as a core atomization region, and the core atomization region is a region in which the heating element is intensively distributed;

wherein during a normal operation, after the heating element is heated for a preset time period, a first average temperature of the core atomization region is higher than a second average temperature of the atomization surface;

a liquid storage chamber, configured to store liquid medium; and a liquid guiding element, connected to the heating assembly and the liquid storage chamber.

15. The atomizer as claimed in claim 14, wherein the liquid guiding element is made of porous material, and the liquid guiding element comprises at least one honeycomb hole arranged in a honeycomb shape.

16. The atomizer as claim in claim 14, wherein a temperature difference between the first average temperature and the second average temperature is configured to enable a part of the liquid medium in a periphery of the core atomization region to flow towards the core atomization region.

17. The atomizer as claim in claim 14, wherein a width of the heating element keeps substantially constant in an extending direction of the heating element, and the core atomization region is located in a center position of the atomization surface.

18. The atomizer as claim in claim 14, wherein the atomization surface has a first width, the core atomization region has a second width along an extending direction of the first width, and a ratio of the second width to the first width is 30%-85%.

19. The atomizer as claim in claim 14, wherein the heating element comprises a first horizontal straight section, a second horizontal straight section, and a connecting section connected to the first horizontal straight section and the second horizontal straight section; the second horizontal straight section is substantially parallel to the first horizontal straight section; the connecting section comprises a first arc section connected to the first horizontal straight section, a second arc section connected to the second horizontal straight section, and a first oblique straight section connected to the first arc section and the second arc section; wherein the first arc section and the second arc section are located on a same circumference, and the first arc section and the second arc section are disposed adjacent to or located at an edge of the core atomization region; or wherein the at least one third horizontal straight section is substantially perpendicular to the first horizontal straight section; or the connecting section comprises at least one second oblique straight section, at least one third oblique straight section, and at least one fourth horizontal straight section connected to the at least one second oblique straight section and the at least one third oblique straight section, and substantially parallel to the first horizontal straight section; wherein the at least one second oblique straight section is intersected with the at least one third oblique straight section, and an angle between the at least one second oblique straight section and the at least one fourth horizontal straight section is substantially equal to an angle between the at least one third oblique straight section and the at least one fourth horizontal straight section.

20. An electronic atomization device, comprising:

a power supply device; and an atomizer, electrically connected to the power supply device and comprising:

a heating assembly, comprising:

a porous body, configured to suck liquid medium and comprising a first surface and a second surface opposite to the first surface; and a heating element, configured to heat and atomize the liquid medium sucked in the porous body;

wherein the first surface is an atomization surface configured to mount the heating element;

wherein the second surface is recessed inwards to form a liquid guiding hole configured to receive a liquid guiding element, the liquid guiding hole has a bottom surface, a projection region of the bottom surface projected on the atomization surface is defined as a core atomization region, and the core atomization region is a region in which the heating element is intensively distributed;

wherein during a normal operation, after the heating element is heated for a preset time period, a first average temperature of the core atomization region is higher than a second average temperature of the atomization surface;

a liquid storage chamber, configured to store liquid medium; and a liquid guiding element, connected to the heating assembly and the liquid storage chamber.

* * * * *